US010544383B2

(12) United States Patent
Vandenberghe et al.

(10) Patent No.: US 10,544,383 B2
(45) Date of Patent: Jan. 28, 2020

(54) DISHWASHING DETERGENT COMPOSITION COMPRISING A BRANCHED ANIONIC/AMINE OXIDE SURFACTANT MIXTURE

(71) Applicant: The Procter & Gamble Company, Cincinnati, OH (US)

(72) Inventors: Frederik Clara Vandenberghe, Sint-Amands (BE); Jean-Luc Philippe Bettiol, Etterbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 13 days.

(21) Appl. No.: 15/656,291

(22) Filed: Jul. 21, 2017

(65) Prior Publication Data

US 2018/0023036 A1 Jan. 25, 2018

Related U.S. Application Data

(60) Provisional application No. 62/365,394, filed on Jul. 22, 2016.

(51) Int. Cl.

| | |
|---|---|
| ***C11D 1/12*** | (2006.01) |
| ***C11D 1/75*** | (2006.01) |
| ***C11D 1/83*** | (2006.01) |
| *C11D 1/14* | (2006.01) |
| *C11D 1/29* | (2006.01) |

(52) U.S. Cl.

CPC ..... *C11D 1/83* (2013.01); *C11D 1/14* (2013.01); *C11D 1/29* (2013.01); *C11D 1/75* (2013.01)

(58) Field of Classification Search

CPC ..... C11D 1/75; C11D 1/12; C11D 3/0094; C11D 3/3418

See application file for complete search history.

(56) References Cited

U.S. PATENT DOCUMENTS

| | | | | |
|---|---|---|---|---|
| 3,563,901 A | | 2/1971 | Crotty | |
| 5,716,626 A | * | 2/1998 | Sakurai | A61K 8/046 424/401 |
| 5,858,950 A | * | 1/1999 | Surutzidis | C11D 1/143 510/350 |
| 5,872,088 A | * | 2/1999 | Pucci | C11D 1/83 510/238 |
| 5,910,477 A | * | 6/1999 | Gordon | C11D 1/65 510/101 |
| 6,087,309 A | | 7/2000 | Vinson | |
| 6,498,134 B1 | * | 12/2002 | Scheibel | C11D 1/22 510/357 |
| 6,774,099 B1 | * | 8/2004 | Scheibel | C11D 1/83 510/357 |
| 8,993,503 B2 | * | 3/2015 | Keuleers | C11D 1/14 510/237 |
| 2001/0016565 A1 | * | 8/2001 | Bodet | C11D 1/37 510/220 |
| 2005/0119152 A1 | * | 6/2005 | Hecht | C11D 1/10 510/503 |
| 2009/0264334 A1 | * | 10/2009 | Ferreyra | C11D 1/37 510/420 |
| 2011/0274770 A1 | * | 11/2011 | Scholz | A01N 59/12 424/672 |
| 2015/0353868 A1 | * | 12/2015 | Bettiol | C11D 3/201 510/235 |
| 2016/0068785 A1 | * | 3/2016 | Vinson | C11D 1/146 510/295 |

FOREIGN PATENT DOCUMENTS

| | | | |
|---|---|---|---|
| EP | 2338961 | A1 | 6/2011 |
| EP | 2420558 | A1 | 2/2012 |
| EP | 2757143 | A1 | 7/2014 |
| JP | 5765654 | B2 | 6/2015 |
| JP | 5779392 | B2 | 7/2015 |
| WO | WO9618711 | A1 | 6/1996 |
| WO | WO9919449 | A1 | 4/1999 |
| WO | WO2014113560 | A1 | 7/2014 |

OTHER PUBLICATIONS

Search Report; Serial No. PCT/US2017/040997; dated Jul. 7, 2017; 14 Pages.

* cited by examiner

*Primary Examiner* — Charles I Boyer
(74) *Attorney, Agent, or Firm* — Abbey A. Lopez

(57) ABSTRACT

Dishwashing detergent composition comprising an anionic surfactant system comprising an average percentage of branching of greater than or equal to 5% to less than 24%; and at least one branched anionic surfactant derived from a 100% branched alcohol.

9 Claims, 3 Drawing Sheets

Inventive Example B

Comparative Example B

Inventive Example C

Comparative Example C

DISHWASHING DETERGENT COMPOSITION COMPRISING A BRANCHED ANIONIC/AMINE OXIDE SURFACTANT MIXTURE

FIELD OF THE INVENTION

The present invention relates to dishwashing detergent compositions with improved viscosity control at low temperatures in cold environments.

BACKGROUND OF THE INVENTION

Viscosity is an important parameter in delivery and use of dishwashing detergent compositions. In cold climates, it is known that dishwashing detergent compositions tend to become too viscous at low temperatures. When a dishwashing detergent composition exhibits an increased viscosity, it is difficult to pump a surfactant paste formed from the dishwashing detergent composition in and out of storage tanks in a detergent manufacturing facility or to pump a detergent product comprising the detergent composition into a detergent bottle in a manufacturing location. Further, when the dishwashing detergent composition is formulated as a hand dishwashing detergent product, the increased viscosity also renders the detergent product harder to be dispensed from the detergent bottle during use by consumers.

Therefore, a need remains for a dishwashing detergent composition providing good grease cleaning and long lasting suds, while having improved viscosity profiles at low temperatures for improving processing and dosing.

SUMMARY OF THE INVENTION

The present invention relates to a dishwashing detergent composition comprising:

1% to 25%, of a surfactant system by weight of the composition, wherein the surfactant system comprises:

an anionic surfactant system comprising:

an average percentage of branching of greater than or equal to 5% to less than 24%; and 5% to 30% of one or more alkyl sulphate surfactants, by weight of the anionic surfactant system, the one or more alkyl sulphates having the formula I:

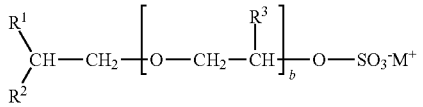

wherein in formula I:

R1 is a C3 to C10 linear or branched alkyl chain, preferably linear alkyl chain;

R2 is a C1 to C8 linear or branched alkyl chain, preferably linear alkyl chain;

R3 is H or C1 to C4 alkyl, preferably H;

R1 equals R2+C2 alkyl;

b is a number from 0 to 5;

$M^+$ is a cation selected from the group consisting of: sodium, calcium, potassium, and magnesium, preferably a sodium cation.

Tighter packing of conventional branched anionic surfactants leads to increased viscosity of detergent compositions at decreasing temperatures. This is avoided by having an alkyl sulphate surfactant with a structure as shown above.

Without wishing to be bound by theory, it is believed the claimed structure results in a 100% branched alkyl sulphate surfactant which acts as a sterical hindrance against tighter packing upon further decreasing the temperature and drives reorientation of surfactants in the surfactant system at low temperatures. As a result, the claimed surfactant system exhibits less efficient packing relative to conventional branched anionic surfactants which can result in decreasing viscosity at low temperatures. This results in a dishwashing detergent composition with improved viscosity control at low temperatures for ease of manufacturability and usability.

DETAILED DESCRIPTION OF THE INVENTION

Figure 1:
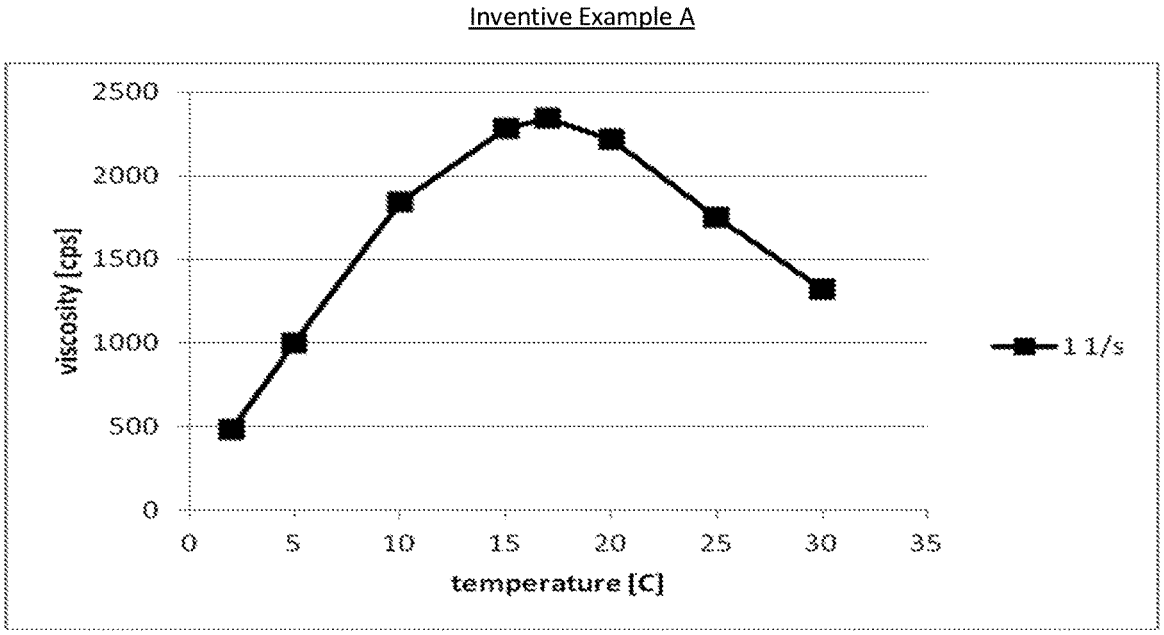
FIG. 1 is a graph plotting viscosity of a liquid detergent composition comprising one or more alkyl sulphate surfactants according to the present invention (Inventive Example A) as a function of temperature.

As used herein "liquid dish detergent composition" refers to those compositions that are employed in cleaning of dishes manually or automatically in a dishwasher. A preferred liquid dish detergent composition of the present invention is a "liquid hand dish detergent composition", which refers to those compositions that are employed in manual (i.e. hand) cleaning of dishes. Such compositions are generally high sudsing or foaming in nature. By "cleaning", the term comprises applying the liquid hand dishwashing detergent composition to a surface for the purpose of removing undesired residue such as soil, grease, stains and/or disinfecting. By "dish", "dishes", and "dishware", the terms comprise a surface such as dishes, glasses, pots, pans, baking dishes and flatware, made from ceramic, china, metal, glass, plastic (polyethylene, polypropylene, polystyrene, etc.) and wood. By "grease", the term comprises materials comprising at least in part (i.e., at least 0.5 wt % by weight of the grease) saturated and unsaturated fats and oils, preferably oils and fats derived from animal sources such as beef and/or chicken. By "suds profile", the term comprises the amount of sudsing (high or low) and the persistence of sudsing (how sustained or long lasting the suds are) throughout the washing process, resulting from the use of the liquid detergent composition. By "high sudsing" or "long lasting suds", the term comprises liquid hand dishwashing detergent compositions which both generate a high level of suds (i.e. a level of sudsing considered acceptable to the consumer) and where the level of suds is sustained during the dishwashing operation. This is particularly important with respect to liquid dishwashing detergent compositions as the consumer perceives high sudsing as an indicator of the performance of the detergent composition. Moreover, the consumer also uses the sudsing profile as an indicator that the wash solution still contains active detergent ingredients. The consumer usually applies additional liquid hand dishwashing detergent composition when the suds subside. Thus, low sudsing liquid dishwashing detergent composition formulation will tend to be used by the consumer more frequently than is necessary.

By "in its neat form", the term comprises that said composition is applied directly onto the surface to be treated, or onto a cleaning device or implement such as a dish cloth, a sponge or a dish brush without undergoing any significant dilution by the user (immediately) prior to application. "In its neat form", also comprises slight dilutions, for instance, arising from the presence of water on the cleaning device, or the addition of water by the consumer to remove the remaining quantities of the composition from a bottle. Therefore, the composition in its neat form comprises mixtures having the composition and water at ratios ranging from 50:50 to 100:0, preferably 70:30 to 100:0, more preferably 80:20 to 100:0, even more preferably 90:10 to 100:0 depending on the user habits and the cleaning task. For the avoidance of doubt, a ratio of 100:0 is most preferred. By "diluted form", the term comprises that said composition is diluted by the user, typically with water. By "rinsing", the term comprises contacting the dishes cleaned with the composition, with substantial quantities of water after the step of applying the liquid composition onto said dishes. By "substantial quantities", the term comprises usually 1 to 20 litres.

All percentages, ratios and proportions used herein are by weight percent of the liquid hand dishwashing detergent composition. All average values are calculated "by weight" of the liquid hand dishwashing detergent composition, unless otherwise expressly indicated.

Dishwashing Detergent Composition

One aspect of the invention provides for a dishwashing detergent composition (hereinafter "composition"). Preferably the composition is a liquid hand dishwashing detergent composition formulated to provide grease cleaning, long lasting suds and improved viscosity control at decreased temperature exposures. Optional further benefits include soil removal, shine, and hand care. The composition comprises a surfactant system comprising an anionic surfactant system comprising one or more alkyl sulphate surfactants having the formula I:

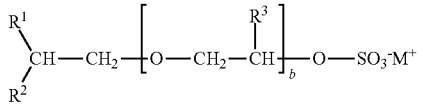

wherein, in formula I:

R1 is a C3 to C10 linear or branched, preferably linear, alkyl chain; more preferably C4 to C8 linear alkyl chain, even more preferably C4 to C5 linear alkyl chain, most preferably C5 alkyl chain.

R2 is a C1 to C8 linear or branched, preferably linear, alkyl chain; more preferably C1 to C5 linear alkyl chain, even more preferably C2 to C3 linear alkyl chain, most preferably C3 linear alkyl chain.

R3 is H or C1 to C4 alkyl, preferably H or methyl, most preferably H;

R1 equals R2+C2;

b is a number from 0 to 5, preferably from 0 to 4, more preferably from 0 to 3;

$M^+$ is a suitable cation which provides charge neutrality, preferably sodium, calcium, potassium, or magnesium, more preferably a sodium cation.

The one or more alkyl sulphate surfactants having formula (I) are derived from alcohols having 100% branching (such as Guerbet alcohols). Tighter packing of conventional branched anionic surfactants leads to increased viscosity of detergent compositions at decreasing temperatures. This is avoided by having an alkyl sulphate surfactant with a structure as shown above. Without wishing to be bound by theory, the position of branching as shown in formula (I) acts as a sterical hindrance against tighter packing upon further decreasing the temperature and drives reorientation of surfactants in the surfactant system at low temperatures. As a result, the claimed surfactant system exhibits less efficient packing relative to conventional branched anionic surfactants which can result in decreasing viscosity at low temperatures. This results in a dishwashing detergent composition with improved viscosity control at low temperatures for ease of manufacturability and usability. Preferably, the one or more alkyl sulphate surfactants having formula I are selected from the group consisting of: alkyl sulphate, alkyl alkoxy sulphate and mixtures thereof, more preferably alkyl alkoxy sulphate (alkoxylated alkyl sulphate). Preferably, the alkoxylation group of the alkoxylated alkyl sulphate having formula I is an ethoxylation group and an average ethoxylation degree of the alkoxylated alkyl sulphate having formula I is 1 to 5.

Preferably, the alkyl sulphate or alkyl alkoxy sulphate is selected from the group consisting of: 2-propylheptyl sulphate and 2-propylheptylethoxysulphate and mixtures thereof.

Preferably, the one or more alkyl sulphate surfactants having formula I are at a level in the range from greater than or equal to 10% to equal to or less than 30%, preferably in the range from greater than or equal to 10% to less than or equal to 25%, more preferably in the range from greater than or equal to 10% to equal to or less than or equal to 20%, most preferably in the range from greater than or equal to 10% to less than or equal to 15%, by weight of the anionic surfactant system.

Preferably, the anionic surfactant system comprises from about at least 5% to about 30%, preferably in the range from greater than or equal to about 10% to equal to or less than about 30%, more preferably in the range from greater than or equal to 10% to less than or equal to 25%, even more preferably in the range from greater than or equal to 10% to equal to or less than or equal to 20%, most preferably in the range from greater than or equal to 10% to less than or equal to 15% of one or more alkyl sulphate surfactants having formula I, by weight of the anionic surfactant system. Further, the anionic surfactant system comprises from about 5%, 7%, 9%, 11%, 13% or 15% to about 17%, 19%, 21%, 23%, 25%, 27%, or 30% of one or more alkyl sulphate surfactants having formula I, by weight of the anionic surfactant system.

Without wishing to be bound by theory, it is believed that a level of the alkyl sulphate surfactant of formula I greater than 30%, by weight of the composition, induces so much sterical hindrance that the surfactant reorientation has already happened even at higher temperatures.

Further, the anionic surfactant system has an average percentage of branching in the range of greater than or equal to 5% to less than 24%, more preferably in the range greater than or equal to 10% to less than 24%, or even more preferably from about 5%, 7%, 9% or 11% to about 13%, 15%, 17%, 19%, 21% or 23%, preferably.

Preferably, the anionic surfactant system has an average anionic surfactant branching level, as defined herein, from 10% to 24%, and an average ethoxylation degree, as defined herein, of from 0.4 to 1.

As the alkyl sulphate surfactant having formula I comprises an average percentage of branching of 100%, it is mixed with at least one anionic surfactant comprising an average branching level of less than 100% in a weight ratio of 1:20 to 3:10, preferably 1:10 to 3:10, more preferably 1:10 to 1:5, such that the abovementioned average percentage of branching in the anionic surfactant system is obtained.

The anionic surfactant system further comprises 70% to 95% by weight of the anionic surfactant system of an anionic surfactant comprising an average branching level of less than 100%, preferably from 0% to less than or equal to 99%.

The anionic surfactant system preferably comprises a mixture of one or more alkyl sulphate surfactants having formula I or at least one alkoxylated, preferably ethoxylated, alkyl sulphate surfactant having formula I or mixtures thereof, and an anionic surfactant comprising an average branching level of less than 100%, selected from the group consisting of: alcohol sulphate surfactant, an alkoxylated, preferably ethoxylated, alcohol sulphate surfactant and mixtures thereof.

Anionic Surfactant (Average Branching Level of Less than 100%)

The anionic surfactant comprising an average branching level of less than 100% can optionally comprise any further anionic surfactant including sulphated, sulphonated or carboxylated anionic surfactant, but preferably is free from any further anionic surfactant including sulphonated or carboxylated anionic surfactants. Short alkyl chain hydrotropic sulphonate compounds such as cumene sulphonate, xylene sulphonate and toluene sulphonate are not considered sulphonated anionic surfactants but are considered as hydrotropes within the scope of this invention.

The liquid hand dishwashing detergent composition of the invention comprises from 1% to 22%, preferably from 5% to 20%, more preferably from 10% to 18%, by weight of the composition, of preferably an alkyl alkoxylated anionic surfactant comprising an average branching level of less than 100%, more preferably an alkyl ethoxylated surfactant having an average degree of ethoxylation, as defined herein, of from 0.2 to 4, preferably from 0.3 to 2, most preferably from 0.5 to 1.

The average degree of ethoxylation is defined as the average number of moles of ethylene oxide per mole of the ethoxylated anionic surfactant of the present invention. Preferably, said ethoxylated anionic surfactant is an ethoxylated alkyl sulphate surfactant of formula II:

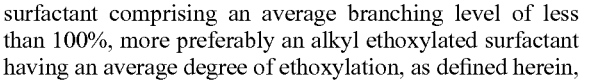

$$R_1—(OCH_2CH_2)_n—O—SO_3^-M^+ \quad (II),$$

wherein:

$R_1$ is a saturated or unsaturated $C_8$-$C_{16}$, preferably $C_{12}$-$C_{14}$ alkyl chain; preferably, $R_1$ is a saturated $C_8$-$C_{16}$, more preferably a saturated $C_{12}$-$C_{14}$ alkyl chain;

n is a number from 0.2 to 4, preferably from 0.3 to 2, most preferably 0.5 to 1;

$M^+$ is a suitable cation which provides charge neutrality, preferably sodium, calcium, potassium, or magnesium, more preferably a sodium cation.

Suitable ethoxylated alkyl sulphate surfactants include saturated $C_8$-$C_{16}$ alkyl ethoxysulphates, preferably saturated $C_{12}$-$C_{14}$ alkyl ethoxysulphates.

The composition according to the invention could optionally further comprise other anionic surfactants. Preferably, the surfactant system comprises at least three or four different anionic surfactants. Suitable anionic surfactants of use in the compositions of the present invention are sulphosuccinates, sulphonates, carboxylates and/or sulphoacetates; preferably alkyl sulphonates. Suitable sulphonate surfactants for use in the compositions herein include water-soluble salts or acids of $C_{10}$-$C_{14}$ alkyl or hydroxyalkyl sulphonates. Suitable counterions include hydrogen, alkali metal cation or ammonium or substituted ammonium, but preferably sodium. Where the hydrocarbyl chain is branched, it preferably comprises $C_{1-4}$ alkyl branching units. The sulphonate surfactants may be selected from $C_{11}$-$C_{18}$ alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). The paraffin sulphonates may be monosulphonates or disulphonates and usually are mixtures thereof, obtained by sulphonating paraffins of 10 to 20 carbon atoms. Preferred sulphonates are those of C12-18 carbon atoms chains and more preferably they are C14-17 chains. Paraffin sulphonates that have the sulphonate group (s) distributed along the paraffin chain are described in U.S. Pat. Nos. 2,503,280; 2,507,088; 3,260,744; 3,372,188 and in DE 735 096. Also suitable are the alkyl glyceryl sulphonate surfactants described in the Procter & Gamble patent application WO06/014740: A mixture of oligomeric alkyl glyceryl sulfonate surfactant selected from dimers, trimers, tetramers, pentamers, hexamers, heptamers, and mixtures thereof; wherein the weight percentage of monomers is from 0 wt % to 60 wt % by weight of the alkyl glyceryl sulfonate surfactant mixture.

Alternatively, the anionic surfactant system may be free of such additional anionic surfactants mentioned in the above, and may optionally further comprises a linear anionic surfactant. By linear, what is meant is that the fatty alcohol comprises a single backbone of carbon atoms, with no branches. An advantage of adding linear anionic surfactants is to provide a detergent composition which contains ingredients that may be derived from natural renewable sources, and the level of surfactants derived from crude oil may be reduced. Specifically, the linear anionic surfactants may be derived from renewal resources or may comprise linear synthetic surfactants.

The linear anionic surfactant can be formulated in an amount of 70% to 95%, by weight of the anionic surfactant system if two alcohols are used to make the surfactant system.

Preparation of Alkyl Sulphate Surfactant of Formula I

Preferably, the one or more alkyl sulphate surfactants having formula I are selected from the group consisting of: Guerbet alkyl sulphate, Guerbet alkyl alkoxy sulphate, and mixtures thereof.

The alkyl sulphate of formula I may be made following the Guerbet reaction into a Guerbet alkyl sulphate, followed by an optional alkoxylation and a sulphation step.

Guerbet Reaction:

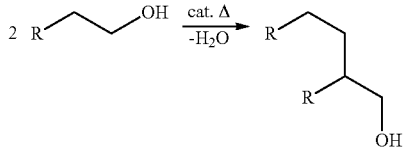

The Guerbet alkyl sulphate preferably is selected from Guerbet alkyl alkoxy sulphate and mixtures thereof, preferably Guerbet alkyl ethoxy sulphate, even more preferably Guerbet alkyl being Guerbet C10 alkyl, even more preferably 2-ethylhexyl alkyl sulphate, 2-ethylhexylethoxysulphate, 2-propylheptyl alkyl sulphate or 2-propylheptylethoxysulphate, most preferably 2-propylheptyl alkyl sulphate or 2-propylheptylethoxysulphate. An advantage of using Guerbet C10 alkyl sulphate is that it does not have a significant base odor and therefore will have less impact on an overall scent of a finished product comprising a perfume formulation.

When alkoxylated, the average alkoxylation preferably ethoxylation degree of the Guerbet alkyl sulphate is from 1 to 5 preferably from 1 to 3. The anionic surfactant system comprising a blend of a Guerbet alkyl sulphate or Guerbet alkyl alkoxy sulphate or mixtures thereof and at least one anionic surfactant comprising an average branching level of less than 100% selected from the group consisting of: alkyl sulphate, alkyl alkoxy sulphate, and mixtures thereof, preferably comprising at least 5% of Guerbet alkyl sulphate or alkyl alkoxy sulphate surfactant, more preferably from 5 to 30% or 10% to 30% or 10% to 20% of Guerbet alkyl sulphate or alkyl alkoxy sulphate surfactant, by weight of the total anionic surfactant. Preferred Guerbet alkyl sulphated surfactants could be obtained through sulphating Lutensol XP, Lutensol XP10, Lutensol XP20, Lutensol XP30, Lutensol XP40 or Lutensol XP50 Guerbet alcohols available from the BASF company. An example of the structure of a Guerbet alkyl ethoxylated sulphate such as 2-propylheptylethoxysulphate is shown below:

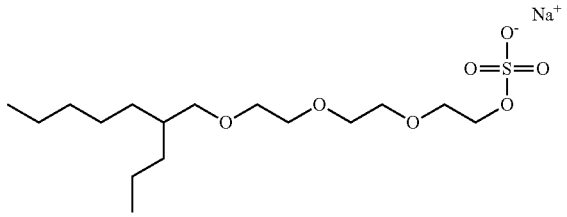

When the sulphated anionic surfactant is a mixture of sulphated anionic surfactants, the average alkoxylation degree is the weight average alkoxylation degree of all the components of the mixture. In the weight average alkoxylation degree calculation the weight of sulphated anionic surfactant components not having alkoxylated groups should also be included.

Weight average alkoxylation degree=
($x1$*alkoxylation degree of surfactant 1+$x2$*alkoxylation degree of surfactant 2+ . . . )/($x1$+$x2$+ . . . ), wherein x1, x2, . . . are the weights in grams of each sulphated anionic surfactant of the mixture and alkoxylation degree is the number of alkoxy groups in each sulphated anionic surfactant.

In the case of a surfactant mixture, the average percentage of branching is the weight average and it is defined according to the following formula:

Weight average of branching (%)=[($x1$*wt % branched alcohol 1 in alcohol 1+$x2$*wt % branched alcohol 2 in alcohol 2+ . . . )/($x1$+$x2$+ . . . )]*100, wherein:

x1, x2, . . . are the weight in grams of each alcohol in the total alcohol mixture of the alcohols which were used as starting material for the anionic surfactant for the detergent of the invention.

It will be appreciated by a person skilled in the art that the wt % branched alcohol i in alcohol i is defined in the unethoxylated starting alcohol, and not in the ethoxylated alcohol or sulphated anionic surfactant. As such when starting from wt % of the individual anionic surfactants, the wt % of the individual anionic surfactants is first converted to the wt % of the respective unethoxylated alcohols prior to calculating the average branching level. For example, if there is 10% of an ethoxylated alcohol, to calculate the branching level impact of that alcohol, the 10% will first have to be recalculated to the unethoxylated alcohol fraction.

In the weight average branching degree calculation the weight of starting alcohols in anionic surfactant components not having branched groups should also be included.

The surfactant system may be in an amount of from about 1%, 5%, 10%, 13% or 14% to 15%, 20% or 25%, preferably from 5% to 20%, more preferably from 10% to 20%, by weight of the composition. The anionic surfactant system may be in an amount of from about 10%, 12%, or 14% to 16% or 18%, preferably in the range from 10% to 18%, by weight of the composition.

Co-Surfactants

The compositions of the invention may also contain certain co-surfactants to aid in the foaming, detergency, and/or mildness. Optionally, the surfactant system may comprise a co-surfactant comprising an amphoteric or a zwitterionic surfactant. Optionally, the surfactant system may comprise a non-ionic surfactant, a cationic surfactant and mixtures thereof.

One aspect of the invention provides a co-surfactant (defined below) comprising 1% to 15%, preferably from 2% to 12%, more preferably from 3% to 10%, alternatively combinations thereof, by weight of the surfactant system. The co-surfactant is selected from an amphoteric surfactant, a zwitterionic surfactant, and mixtures thereof. In a preferred embodiment, the composition of the present invention will preferably comprise an amine oxide as the amphoteric surfactant or betaine as the zwitterionic surfactant, or a mixture of said amine oxide and betaine surfactants, preferably an amine oxide.

Amphoteric Surfactant

The liquid hand dishwashing detergent composition of the invention preferably comprises from 1% to 15%, preferably from 2% to 12%, more preferably from 3% to 10% by weight of the composition of an amphoteric surfactant, preferably an amine oxide surfactant. Preferably the composition of the invention comprises a mixture of the anionic surfactant system comprising the Guerbet anionic sulphate surfactant, and alkyl dimethyl amine oxide in a weight ratio of less than about 8:1, more preferably less than about 5:1, more preferably from about 4:1 to about 2:1.

For example, the liquid composition further comprising from 3% to 10% by weight of the composition of an alkyl dimethyl amine oxide surfactant, the anionic surfactant and the alkyl dimethyl amine oxide being formulated in a weight ratio of from about 4:1 to about 2:1, and optionally further comprising an alcohol ethoxylate non-ionic surfactant Addition of the amphoteric surfactant provides good sudsing properties in the detergent composition. Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl.

The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the α carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Surfactant

The liquid hand dishwashing detergent composition of the invention optionally comprises from 1% to 15%, preferably from 2% to 12%, more preferably from 3% to 10% by weight of the composition of a zwitterionic surfactant, preferably a betaine surfactant.

Suitable zwitterionic surfactants include betaines, such as alkyl betaines, alkylamidobetaine, amidazoliniumbetaine, sulfobetaine (INCI Sultaines) as well as the Phosphobetaine and preferably having formula (III):

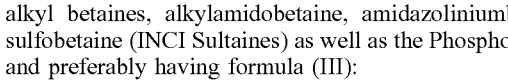

R1-[CO—X(CH2)*n*]*x*-N+(R2)(R3)-(CH2)*m*-[CH(OH)—CH2]*y*-Y— (III), wherein in formula (III):

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, 0 or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(O)(OR5)O, whereby R5 is a hydrogen atom H or a C1-4 alkyl residue.

Preferred betaines are the alkyl betaines of the formula (Ma), the alkyl amido propyl betaine of the formula (IIIb), the Sulfo betaines of the formula (IIIc) and the Amido sulfobetaine of the formula (IIId);

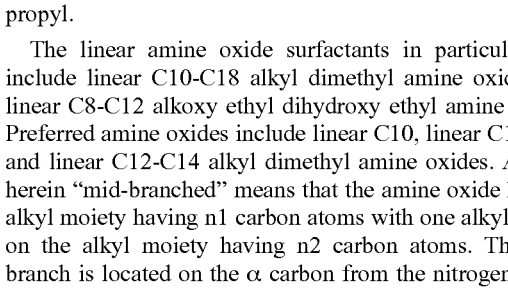

R1-N+(CH3)2-CH2COO— (IIIa)

R1-CO—NH(CH2)3-N+(CH3)2-CH2COO— (IIIb)

R1-N+(CH3)2-CH2CH(OH)CH2SO3- (IIIc)

R1-CO—NH—(CH2)3-N+(CH3)2-CH2CH(OH)CH2SO3- (Id)

in which R11 as the same meaning as in formula I. Particularly preferred betaines are the Carbobetaine [wherein Y—═COO—], in particular the Carbobetaine of the formula (Ma) and (IIIb), more preferred are the Alkylamidobetaine of the formula (IIIb).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines. A preferred betaine is, for example, Cocoamidopropylbetaine. The zwitterionic surfactant preferably is a betaine surfactant, more preferable a CAP-betaine surfactant.

Non-Ionic Surfactant

The liquid composition can optionally further comprises a non-ionic surfactant, preferably an ethoxylated alcohol surfactant. The non-ionic surfactant, when present, is comprised in a typical amount of from 0.1% to 10%, preferably 0.2% to 5%, most preferably 0.3% to 2% by weight of the composition.

Suitable non-ionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred non-ionic surfactants are the condensation products of Guerbet alcohols with from 2 to 18 moles, preferably 2 to 15, more preferably 5-12 of ethylene oxide per mole of alcohol. Other suitable non-ionic surfactants for use herein include fatty alcohol polyglycol ethers, alkylpolyglucosides and fatty acid glucamides.

Cationic Surfactants

The present compositions may optionally comprise a cationic surfactant. Cationic surfactants, when present in the composition, are present in an effective amount, more preferably from 0.1% to 5%, preferably 0.2% to 2% by weight of the composition. Suitable cationic surfactants are quaternary ammonium surfactants, preferably selected from mono $C_6$-$C_{16}$, more preferably $C_6$-$C_{10}$ N-alkyl or alkenyl ammonium surfactants, wherein the remaining N positions are substituted by methyl, hydroxyethyl or hydroxypropyl groups. Another preferred cationic surfactant is a $C_6$-$C_{18}$ alkyl or alkenyl ester of a quaternary ammonium alcohol, such as quaternary chlorine esters. More preferably, the cationic surfactants have the formula (V):

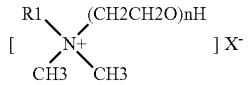

(V)

wherein $R^1$ of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and $X^-$ of formula (V) is an anion, preferably, chloride or bromide.

Solvents

The compositions may optionally comprise a solvent. Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When present, the liquid detergent composition will contain from 0.01% to 20%, preferably from 0.5% to 15%, more preferably from 1% to 10%, most preferably from 1 to 5% by weight of the liquid detergent composition of a solvent. These solvents may be used in conjunction with an aqueous liquid carrier, such as water, or they may be used without any aqueous liquid carrier being present. At higher solvent systems, the absolute values of the viscosity may drop but there is a local maximum point in the viscosity profile.

The compositions herein may further comprise from 30% to 90% by weight of an aqueous liquid carrier, comprising water, in which the other essential and optional ingredients are dissolved, dispersed or suspended. More preferably the compositions of the present invention comprise from 45% to 85%, more preferable from 60% to 80% of the aqueous liquid carrier. The aqueous liquid carrier, however, may contain other materials which are liquid, or which dissolve in the liquid carrier, at room temperature (20° C. to 25° C.) and which may also serve some other function besides that of an inert filler.

Hydrotropes

The liquid detergent compositions of the invention may optionally comprise a hydrotrope in an effective amount so that the liquid detergent compositions are appropriately compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, and related compounds, as disclosed in U.S. Pat. No. 3,915,903. The liquid detergent compositions of the present invention typically comprise from 0% to 15% by weight of the total liquid detergent composition of a hydrotrope, or mixtures thereof, preferably from 1% to 10%, most preferably from 2% to 5% by weight of the total liquid hand dishwashing composition.

Electrolytes

The liquid composition according to the invention might further comprise from 0.1 to 5%, preferably from 0.2 to 2% by weight of the composition of an electrolyte preferably selected from inorganic salts, even more preferably selected from monovalent salts, most preferably sodium chloride.

Optional Ingredients

The composition herein may comprise a number of optional ingredients such as but not limited to preservatives, conditioning polymers, cleaning polymers, surface modifying polymers, soil flocculating polymers, rheology modifying polymers, structurants, builders, chelants, cyclic diamines, structurants, emollients, humectants, skin rejuvenating actives, carboxylic acids, scrubbing particles, bleach and bleach activators, perfumes, malodor control agents, pigments, dyes, opacifiers, beads, pearlescent particles, microcapsules, antibacterial agents, pH adjusters including NaOH and alkanolamines such as monoethanolamines, buffering means, and divalent salts including divalent salts comprising magnesium and calcium cations.

The liquid detergent composition may have any suitable pH. Preferably the pH of the composition is adjusted to between 4 and 14. More preferably the composition has a pH of from 6 to 13, even more preferably from 6 to 10, most preferably from 8 to 10. The pH of the composition can be adjusted using pH modifying ingredients known in the art and is measured as a 10% product concentration in demineralised water at 25 degrees C. For example, NaOH may be used as shown in Tables I, II, III and the actual wt % of NaOH may be varied and trimmed up to the desired pH such as pH 9.0.

Viscosity

Compositions according to the invention can be in the form of a liquid, semi-liquid, cream, lotion or gel compositions and, in some embodiments, are intended for use as liquid hand dishwashing detergent compositions for direct or indirect application onto dishware.

Figure 3:
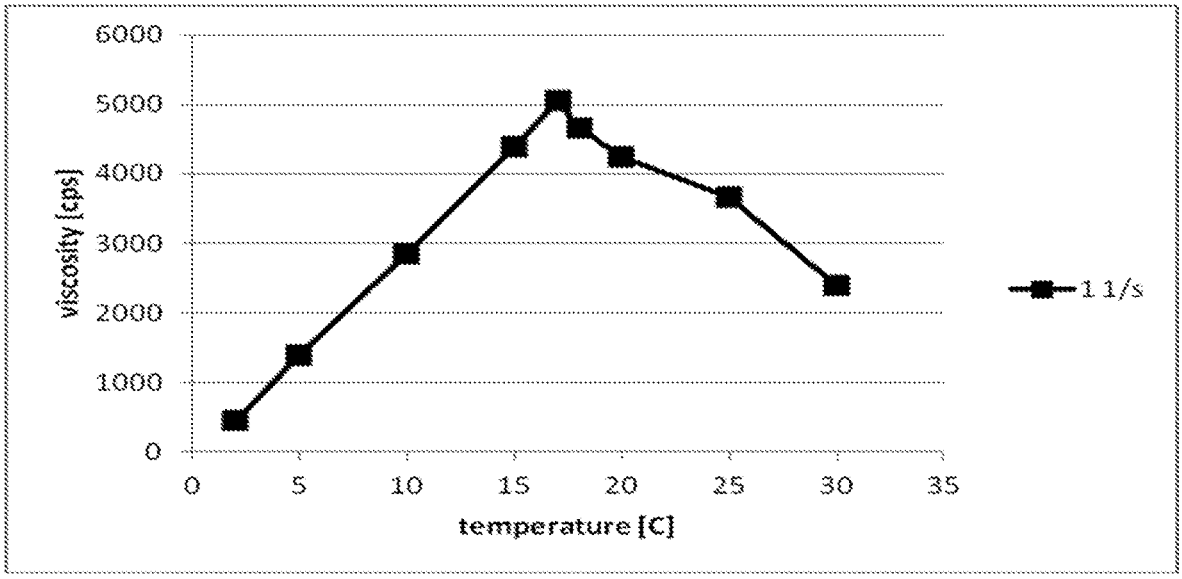
FIG. 3 is a graph plotting viscosity of a liquid detergent composition comprising a total surfactant level according to the present invention (Inventive Example B) as a function of temperature.
Figure 5:
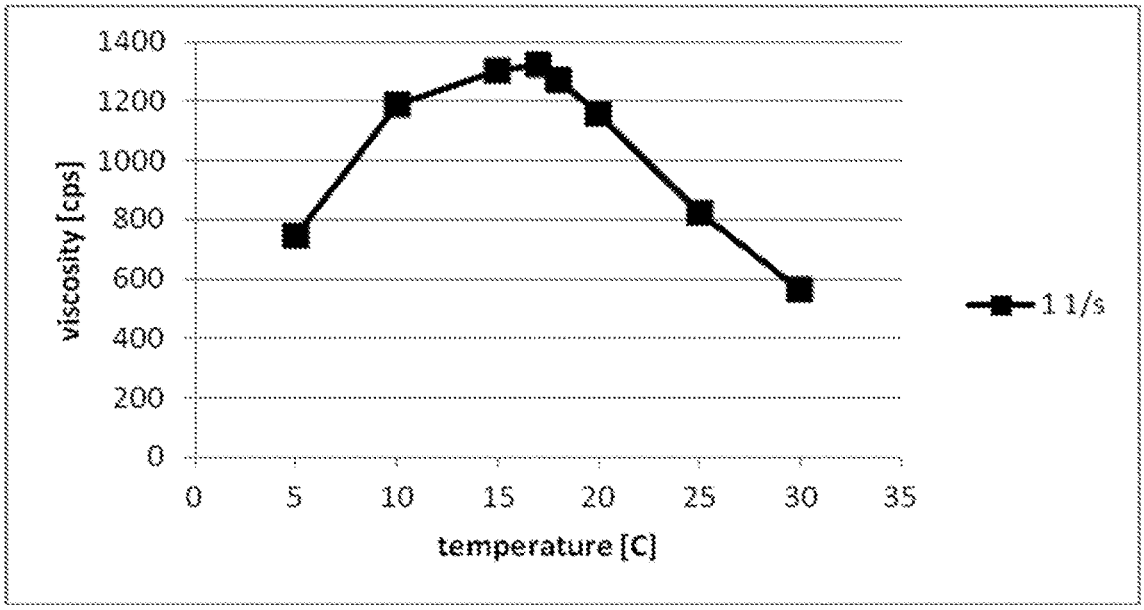
FIG. 5 is a graph plotting viscosity of a liquid detergent composition comprising an anionic surfactant system having an average branching level according to the present invention (Inventive Example C) as a function of temperature.

FIGS. 1, 3 and 5 show that by adding the alkyl sulphate surfactant having formula I in an anionic surfactant system for a detergent composition, the viscosity of the detergent composition increases as the temperature decreases from 20° C. to define a local maximum point in a viscosity-temperature profile at low temperatures between 5 and 20° C., but decreases upon the temperature decreasing below the temperature at the local maximum point down to 5° C. The compositions of the present invention preferably have a viscosity of from 50 to 4000 centipoises (50 to 4000 mPa*s), more preferably from 100 to 2000 centipoises (100 to 2000 mPa*s), and most preferably from 500 to 1500 centipoises (500 to 1500 mPa*s) at 20 $s^{-1}$ and 20° C.

This results in a dishwashing detergent composition with improved viscosity control at low temperatures for ease of washing dishware when consumers use the dishwashing detergent composition at low temperatures.

Method of Washing

Compositions according to the invention can be used for washing dishware. Said method of washing dishes comprises the step of applying the composition, preferably in liquid form, onto the dishware surface, either directly or by means of a cleaning implement, i.e., in neat form.

The composition is applied directly onto the surface to be treated and/or onto a cleaning device or implement such as a dish cloth, a sponge or a dish brush without undergoing major dilution (immediately) prior to the application. The cleaning device or implement is preferably wet before or after the composition is delivered to it. In the method of the invention, the composition can also be applied in diluted form. Both neat and dilute application give rise to good and long lasting suds in the presence in fat and/or oily soils, even when the level of surfactant used is lower than in conventional compositions.

EXAMPLES

In the following Examples, all levels are quoted as % by weight of the composition unless otherwise specified. The following examples are illustrative of the present invention, but are not meant to limit or otherwise define its scope. All parts, percentages and ratios used herein are expressed as percent weight unless otherwise specified.

Figure 2:
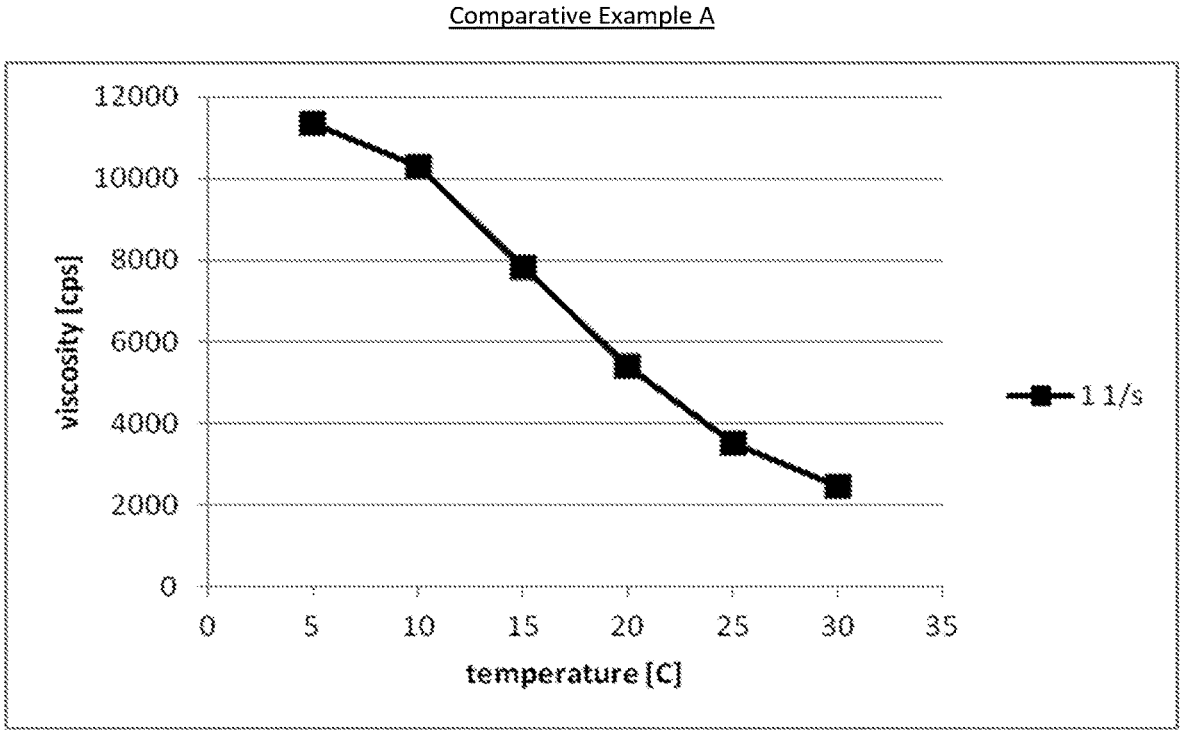
FIG. 2 is a graph plotting viscosity of a liquid detergent composition comprising one or more alkyl sulphate surfactants comprising an average branching level of less than 100% (Comparative Example A) as a function of temperature.
Figure 4:
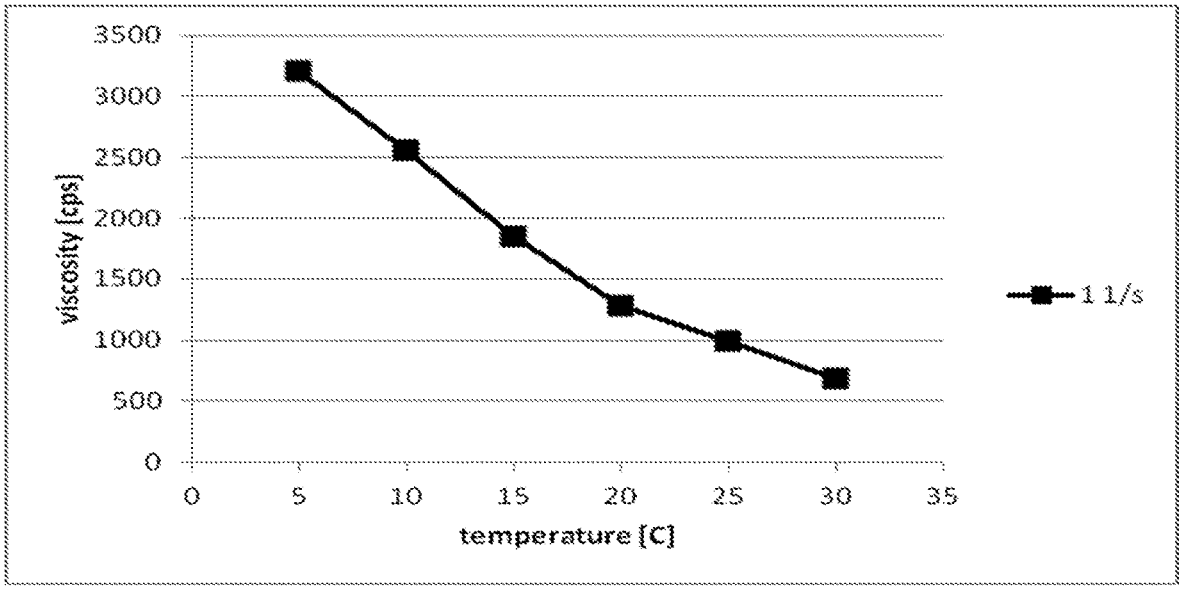
FIG. 4 is a graph plotting viscosity of a liquid detergent composition having a total surfactant level greater than 26% (Comparative Example B) as a function of temperature.
Figure 6:
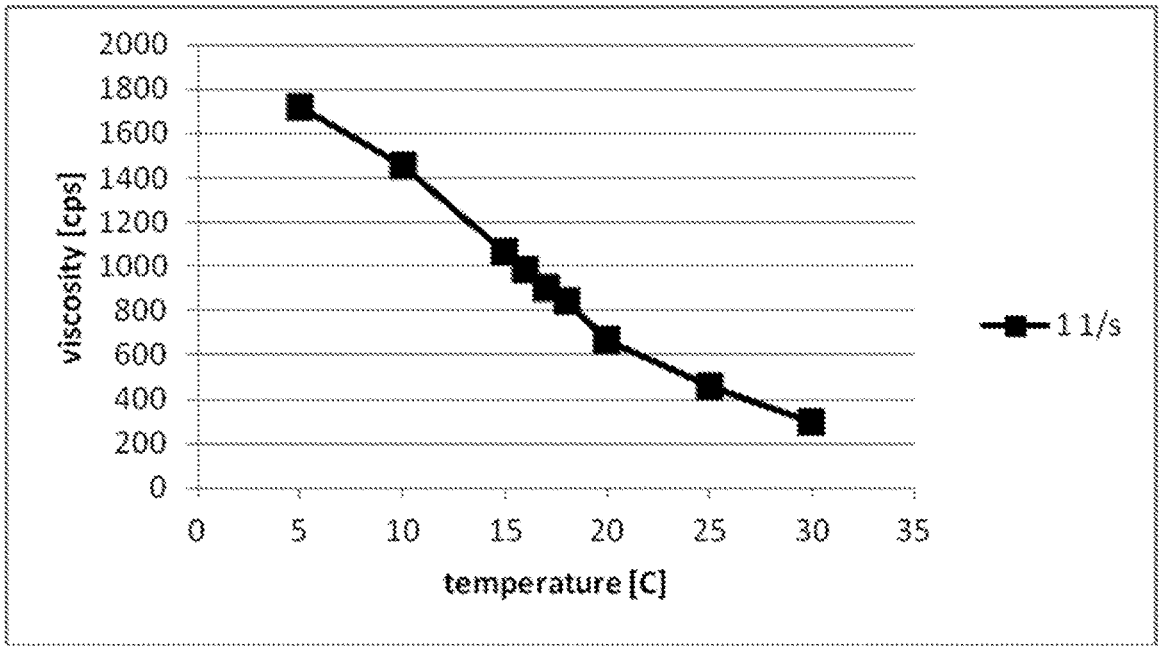
FIG. 6 is a graph plotting viscosity of a liquid detergent composition having an anionic surfactant system having an average branching level greater than 23% (Comparative Example C) as a function of temperature.

The parameters and ingredients used for compositions according to the invention (Inventive Examples) and Comparative Examples are set forth in Tables I, II and III below. A viscosity profile of each of Inventive Examples of FIGS. 1, 3, and 5 as well as of Comparative Examples of FIGS. 2, 4, and 6, is measured using a Discovery HR-1 hybrid rheometer from TA instruments to which a Julabo FS15 Thermostatic Bath is connected. The measurements are carried out via using a spindle of 40 mm diameter, 2.008° conical plate, Peltier plate steel and according to the following method comprising steps of:

Step (i) Sample Pre-Conditioning:
- Enter sample name and requested measuring temperature
- Let sample adjust towards desired temperature, gap set to 56 micron
- Let samples equilibrate for 30 seconds at the desired temperature
- No pre-shear is performed Step (ii) Flow Ramp:
- 180 seconds duration
- Shear rate from 0.01 $s^{-1}$ to 1,000 $s^{-1}$, expressed in logarithmic scale
- 10 points measured per logarithmic decade Step (ii) is Repeated at 5° C., 10° C., 15° C., 17° C., 18° C., 20° C., 25° C. and 30° C.

A plot of the viscosity vs. shear rate is used to determine the low shear viscosity at 1 $s^{-1}$(1/s), and this is plotted for every temperature as shown in the graphs of viscosity versus temperatures (see FIGS. 1, 2, 3, 4, 5 and 6). Further, the above method allows measurement of both viscosity values at 20 $s^{-1}$ and 1 $s^{-1}$. The viscosity values at 20 $s^{-1}$ and 1 $s^{-1}$ of the Inventive Examples and the Comparative Examples are the same at the same temperature as the compositions are Newtonian fluids. Tables I, II, and III show the viscosity values of the Inventive Examples and the Comparative Examples at 20 $s^{-1}$ and 20° C.

FIGS. 1, 3 and 5 respectively show that the viscosity of Inventive Examples A, B, C respectively increases when dropping the temperature to about 17° C. and then re-decreases when further lowering the temperature. Specifically, the viscosity of a dishwashing detergent composition based of the claimed surfactant system increases as the temperature decreases below 20° C. to define a local maximum point in a viscosity-temperature profile at low temperatures between 5° C. and 20° C., but decreases upon the temperature decreasing below the temperature at the local maximum point down to 5° C.

In contrast, FIGS. 2, 4, 6 respectively show that the viscosity of the Comparative Examples A, B and C respectively increases at decreasing temperature. Reasons for the difference in the viscosity behaviour will be explained in the following description.

FIG. 1 shows a graph of viscosity versus temperature for a liquid composition according to the invention comprising a Guerbet alkyl sulphate surfactant having formula I (Inventive Example A) and FIG. 2 shows a graph of viscosity versus temperature for a liquid composition with one or more alkyl sulphate surfactants comprising an average branching level of less than 100% (Comparative Example A). The parameters and ingredients for making the composition of the Inventive Example A and the Comparative Example A respectively is set forth in Table I below:

TABLE I

| Parameters | Comparative Example A | Inventive Example A |
|---|---|---|
| Level of Guerbet alkyl sulphate surfactant (AES - Guerbet), by weight of the anionic surfactant system | None | 13.6% |
| average branching | 20.96% | 19.56% |
| average ethoxylation degree | 0.60 | 0.60 |
| Viscosity at 20 $s^{-1}$ and 20° C. (centipoise, cps, mPa · s) | 5,391 cps (mPa · s) | 2,220 cps (mPa · s) |

TABLE I-continued

| Components, by weight of the Composition | Wt (%) | Wt (%) |
|---|---|---|
| Total surfactant | 13.40 | 13.40 |
| Alkyl sulphate (AS) comprising an average branching level of less than 100% | 6.34 | 6.80 |
| Alkyl ethoxy-2-sulphate (AE2S) comprising an average branching level of less than 100% | 2.80 | 1.88 |
| AE3S comprising an average branching level of less than 100% | 0.76 | — |
| AE3S - Guerbet alkyl sulphate surfactant having formula I (derived from Lutensol XP30) | — | 1.37 |
| Lutensol XP80 | 0.20 | — |
| C12-14 dimethyl amineoxide | 3.30 | 3.35 |
| Sodium chloride | 1.00 | 1.00 |
| Polypropyleneglycol (MW 2000) | 0.035 | — |
| Perfume | 0.13 | 0.13 |
| NaOH | up to pH 9.0 | up to pH 9.0 |
| Water and minors (dyes, preservatives) | up to 100 | up to 100 |

As shown in FIG. 1, the viscosity of Inventive Example A does not follow the same viscosity profile as the Comparative Example A (see FIG. 2) in which the viscosity of the Comparative Example A increases with decreasing temperature.

FIG. 3 shows a graph of viscosity versus temperature for a liquid composition comprising a Guerbet alkyl sulphate surfactant and a total surfactant level according to the present invention (Inventive Example B). FIG. 4 shows a graph of viscosity versus temperature for a liquid composition comprising a Guerbet alkyl sulphate surfactant and a total surfactant level greater than 25% (Comparative Example B). The composition of the Inventive Example B and the Comparative Example B respectively is set forth in Table II below:

TABLE II

| Parameters | Comparative Example B | Inventive Example B |
|---|---|---|
| Level of Guerbet alkyl sulphate surfactant, by weight of the anionic surfactant system | 10% | 10% |
| average branching | 12.19% | 72.79% |
| average ethoxylation degree | 0.86 | 0.86 |
| Viscosity at 20 $s^{-1}$ and 20° C. (centipoise, cps, mPa · s) | 1,278 cps (mPa · s) | 4,239 cps (mPa · s) |
| **Components, by weight of the Composition** | **Wt (%)** | **Wt (%)** |
| Total surfactant | 27.19 | 13.40 |
| AS comprising an average branching level of less than 100% | 10.40 | 5.12 |
| AE2S comprising an average branching level of less than 100% | 7.67 | 3.78 |
| AE3S - Guerbet alkyl sulphate surfactant (derived from Lutensol XP30) | 2.01 | 0.99 |
| Lutensol XP80 | 0.42 | 0.21 |
| C12-14 dimethyl amineoxide | 6.69 | 3.30 |
| Sodium chloride | 0.80 | 1.00 |
| Polypropyleneglycol (MW 2000) | 1.00 | — |
| Ethanol | 2.22 | — |
| Sodium citrate | 0.50 | — |
| Perfume | 0.13 | 0.13 |
| NaOH | up to pH 9.0 | up to pH 9.0 |
| Water and minors (preservatives, dyes) | up to 100 | up to 100 |

In addition to the reasons as set out for Inventive Example A, Inventive Example B also exhibits a reduced viscosity at decreasing temperatures after the local maximum point (see FIG. 3).

Without wishing to be bound by theory, it is believed that the reduced viscosity is due to the level of surfactant in the Inventive Example B being at a level of less than 25%, i.e. lower relative to Comparative Example B. The higher level of surfactants in Comparative Example B causes the viscosity to increase due to agglomeration of surfactant micelles at lower temperatures which inhibits reorientation of the individual surfactants in an alternative aggregate structure, and as such prevents the drop in viscosity when decreasing the temperature.

FIG. 5 shows a graph of viscosity versus temperature for a liquid composition comprising a Guerbet alkyl sulphate surfactant and an average branching level according to the invention (Inventive Example C).

FIG. 6 shows a graph of viscosity versus temperature for a liquid composition comprising a Guerbet alkyl sulphate surfactant but an average branching level greater than 24% (comparative example C). The composition of the Inventive Example C and the Comparative Example C respectively is set forth in Table III below:

TABLE III

| | Comparative Example C | Inventive Example C |
|---|---|---|
| Level of Guerbet alkyl sulphate surfactant, by weight of the anionic surfactant system | 13.6% | 13.6% |
| average branching | 29.51% | 19.55% |
| average ethoxylation degree | 0.6 | 0.6 |
| Viscosity at 20 $s^{-1}$ and 20° C. (centipoise, cps, mPa · s) | 666 cps (mPa · s) | 1,157 cps (mPa · s) |
| **Components, by weight of the Composition** | **Wt (%)** | **Wt (%)** |
| Total surfactant | 13.40 | 13.40 |
| AS comprising an average branching level of less than 100% branching | 5.62 | 5.71 |
| AE2S comprising an average branching level of less than 100% | 2.93 | 2.96 |
| AE1S - Guerbet alkyl sulphate surfactant (derived from Lutensol XP10) | 1.35 | 1.37 |
| Lutensol XP80 | 0.20 | |
| C12-14 dimethyl amineoxide | 3.30 | 3.35 |
| Sodium chloride | 1.00 | 1.00 |
| Perfume | 0.13 | 0.13 |
| NaOH | up to pH 9.0 | up to pH 9.0 |
| Water and minors (dyes, preservatives) | up to 100% | up to 100% |

In an example, there is:

A. A dishwashing detergent composition comprising:

1% to 25%, of a surfactant system by weight of the composition, wherein the surfactant system comprises:

an anionic surfactant system comprising:

an average percentage of branching of greater than or equal to 5% to less than 24%; and 5% to 30% of one or more alkyl sulphate surfactants, by weight of the anionic surfactant system, the one or more alkyl sulphates having the formula I:

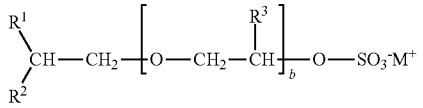

wherein in formula I:

R1 is a C3 to C10 linear or branched alkyl chain, preferably linear alkyl chain;

R2 is a C1 to C8 linear or branched alkyl chain, preferably linear alkyl chain;

R3 is H or C1 to C4 alkyl, preferably H;

R1 equals R2+C2 alkyl;

b is a number from 0 to 5;

$M^+$ is a cation selected from the group consisting of: sodium, calcium, potassium, and magnesium, preferably a sodium cation.

B. The composition according to A, wherein the one or more alkyl sulphate surfactants having formula I is selected from the group consisting of: alkyl sulphate or alkyl alkoxy sulphate or mixtures thereof, preferably alkyl alkoxy sulphate (alkoxylated alkyl sulphate).

C. The composition according to B, wherein the alkyl sulphate or alkyl alkoxy sulphate is selected from the group consisting of: 2-propylheptyl sulphate and 2-propylheptylethoxysulphate and mixtures thereof.

D. The composition according to C, wherein the alkoxylation group of the alkoxylated alkyl sulphate having formula I is an ethoxylation group.

E. The composition according to E, wherein an average ethoxylation degree of the alkoxylated alkyl sulphate having formula I is 1 to 5.

F. The composition according to A, wherein the one or more alkyl sulphate surfactants having formula I is at a level in the range from greater than or equal to 10% to equal to or less than 30%, preferably in the range from greater than or equal to 10% to less than or equal to 25%, more preferably in the range from greater than or equal to 10% to equal to or less than or equal to 20%, most preferably in the range from greater than or equal to 10% to less than or equal to 15%, by weight of the anionic surfactant system.

G. The composition according to A, wherein the one or more alkyl sulphate surfactants having formula I is selected from the group consisting of: Guerbet alkyl sulphate, Guerbet alkyl alkoxy sulphate, and mixtures thereof.

H. The composition according to A, wherein the anionic surfactant system further comprises:

70% to 95% by weight of the anionic surfactant system of an anionic surfactant derived from alcohols comprising an average branching level of less than 100%.

I. The composition according to H, wherein the anionic surfactant is selected from the group consisting of: linear or branched anionic surfactant or mixtures thereof having the formula II:

R1-(OCH2CH2)*n*-O—SO3-M+ (II), wherein in formula (II):

R1 is a saturated or unsaturated C8-C16, preferably C12-C14 alkyl chain, more preferably a saturated C12-C14 alkyl chain;

n is a number from 0 to 4, preferably from 0 to 3, most preferably 0 to 2;

M+ is a suitable cation which provides charge neutrality, preferably sodium, calcium, potassium, or magnesium, more preferably a sodium cation.

J. The composition according to A wherein the anionic surfactant system comprises an average alkoxylation degree preferably an average ethoxylation degree preferably in the range from greater than or equal to 0.2 to equal to or less than 3, more preferably in the range from greater than or equal to 0.2 to equal to or less than 2, most preferably in the range from greater than or equal to 0.2 to equal to or less than 1.0.

K. The composition according to A, further comprising:

a co-surfactant selected from the group consisting of: an amphoteric surfactant, zwitterionic surfactant, an non-ionic surfactant and mixtures thereof.

L. The composition according to K, wherein the co-surfactant is an amphoteric surfactant preferably an amine oxide, more preferably an alkyl dimethyl amine oxide, even more preferably a C10-C18 alkyl dimethyl amine oxide, most preferably C12-C14 alkyl dimethyl amine oxide.

M. The composition according to L, wherein the anionic surfactant system and the amphoteric surfactant comprise a weight ratio of 10:1 to 1:1, preferably 5:1 to 1.5:1, even more preferably 4:1 to 2:1.

N. The composition according to A, further comprising 0.01% to 20% of a solvent, by weight of the composition, wherein the solvent is selected from the group consisting of $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof.

O. The composition according to A, further comprising 1% to 10% of a hydrotrope by weight of the composition, wherein the hydrotrope is selected from the group consisting of sodium, potassium, and ammonium xylene sulfonate, sodium, potassium and ammonium toluene sulfonate, sodium potassium and ammonium cumene sulfonate, and mixtures thereof.

P. The composition according to A, the composition comprising a viscosity of from about 50 to about 4000 centipoises (50 to 4000 mPa*s) at 20 $s^{-1}$ and 20° C. and a local maximum viscosity between 5° C. and 20° C.

Q. The composition according to A, wherein the pH of the composition is from 6 to 10.

R. The composition according to A, wherein the composition is a liquid hand dishwashing detergent composition.

S. A method of washing dishes comprising applying a composition according to A.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dishwashing detergent composition comprising:

a) a surfactant system comprising:

i) an anionic surfactant system comprising: an average percentage of branching of greater than or equal to 5% to less than 24%, and from 5% to 30% of 2-propylheptyl sulphate, 2-propylheptylethoxysulphate, or mixtures thereof; and ii) an amphoteric surfactant, wherein the amphoteric surfactant comprises a C12-C14 alkyl dimethyl amine oxide, wherein the the anionic surfactant system and the amphoteric surfactant are present in a weight ratio of from 10:1 to 1:1;

b) from 0.01% to 20% by weight of the composition of a solvent, wherein the solvent is selected from the group consisting of $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof; and c) from 1% to 10% by weight of the composition of a hydrotrope, wherein the hydrotrope is selected from the group consisting of sodium, potassium, and ammonium xylene sulfonate, sodium, potassium and ammonium toluene sulfonate, sodium potassium and ammonium cumene sulfonate, and mixtures thereof, wherein the composition comprises a viscosity of from about 50 to about 4000 centipoises at 20 $s^{-1}$ and 20° C., and the viscosity increases to a local maximum point in a viscosity-temperature profile at low temperatures between 5° C. and 20° C. at 1 $s^{-1}$.

2. The composition according to claim 1, wherein the average ethoxylation degree of the 2-propylheptyl(ethoxy) sulphate is 1 to 5.

3. The composition according to claim 1, wherein the 2-proropylheptyl sulphate and/or 2-propyltheptyl(ethoxy) sulphate is present at a level in the range of from greater than or equal to 10% to equal to or less than 30% by weight of the anionic surfactant system.

4. The composition according to claim 1, wherein the anionic surfactant system further comprises:

70% to 95% by weight of the anionic surfactant system of an surfactant derived from alcohols comprising an average branching level of less than 100%.

5. The composition according to claim 4, wherein the anionic surfactant is selected from the group consisting of: linear or branched anionic surfactant or mixtures thereof having the formula II:

$$R1\text{-}(OCH2CH2)n\text{-}O\text{—}SO3\text{-}\ M+ \qquad (II),$$

wherein in formula (II):

R1 is a saturated or unsaturated C8-C16 alkyl chain;

n is a number from 0 to 4;

M+is a suitable cation which provides charge neutrality.

6. The composition according to claim 1, further comprising:

a co-surfactant selected from the group consisting of: an amphoteric surfactant, zwitterionic surfactant, an nonionic surfactant and mixtures thereof.

7. The composition according to claim 1, wherein the pH of the composition is from 6 to 10.

8. The composition according to claim 1, wherein the composition is a liquid hand dishwashing detergent composition.

9. A method of washing dishes comprising applying a composition according to claim 1.

* * * * *